United States Patent [19]

Herschlag

[11] Patent Number: 4,632,459

[45] **Date of Patent: * Dec. 30, 1986**

[54] PORTABLE UPHOLSTERED FURNITURE

[76] Inventor: Herbert Herschlag, 68-15 Groton St., Forest Hills, N.Y. 11375

[ * ] Notice: The portion of the term of this patent subsequent to Jun. 30, 2003 has been disclaimed.

[21] Appl. No.: 605,564

[22] Filed: Apr. 30, 1984

[51] Int. Cl.[4] ..... A47C 7/00

[52] U.S. Cl. ..... 297/440; 297/42; 297/445

[58] Field of Search ..... 297/440, 441, 443, 218, 297/42, 43, 44, 445

[56] References Cited

U.S. PATENT DOCUMENTS

| | | | |
|---|---|---|---|
| 335,037 | 1/1886 | Noel | 297/43 |
| 2,151,985 | 3/1939 | Munroe | 297/440 X |
| 2,829,707 | 4/1958 | Leibson | 297/440 X |
| 2,929,076 | 3/1960 | Ake et al. | 297/443 X |
| 3,799,611 | 3/1974 | Steinfeld | 297/440 |
| 4,244,619 | 1/1981 | Yoshimura | 297/42 X |

FOREIGN PATENT DOCUMENTS

| | | | |
|---|---|---|---|
| 634267 | 2/1962 | Italy | 297/42 |

*Primary Examiner*—James T. McCall

*Attorney, Agent, or Firm*—Elliot A. Lackenbach

[57] ABSTRACT

Portable upholstered furniture is defined by a laterally folding frame having a pair of laterally collapsible side arm frames and a pair of medially foldable parallelogram cross assemblies extending therebetween, at least one generally transversely flexible band of fabric or the like encircling the side arm frames and the cross assemblies, and a cushioned bonnet like upper assembly settable downwardly onto the side arm frames and the upper cross assembly, the encircling band being provided with a plurality of vertically extending strut members supporting the back portion of the cushion assembly and carrying support blocks for supporting the cross assemblies.

18 Claims, 11 Drawing Figures

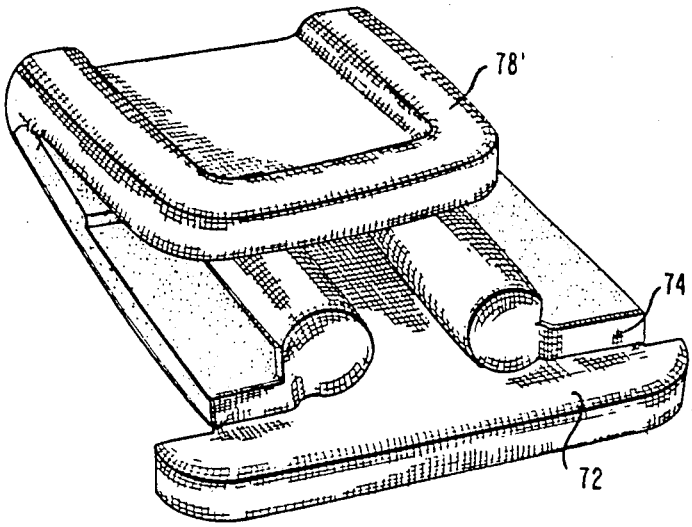
FIG. 8
FIG. 10
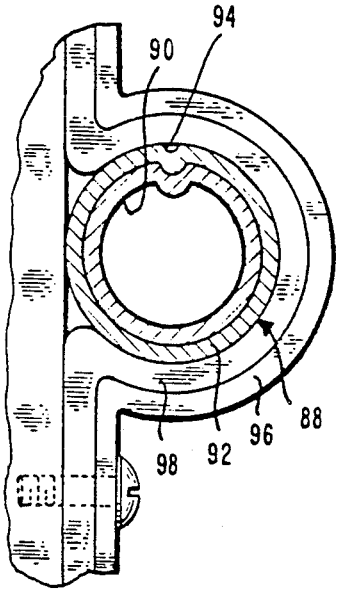
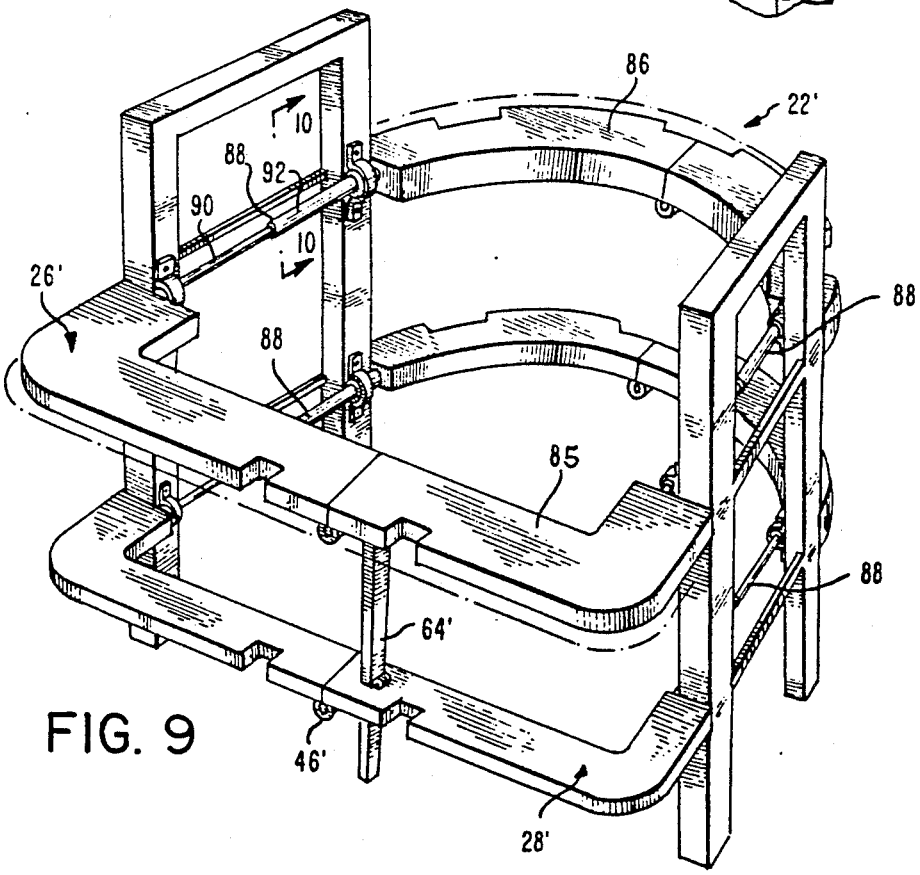
FIG. 9

PORTABLE UPHOLSTERED FURNITURE

FIELD OF THE INVENTION

This invention relates generally to furniture and, more particularly to portable furniture which may be easily stocked, transported, moved, or stored and which yet provides the comfort and appearance of conventional upholstered furniture.

BACKGROUND OF THE INVENTION

Furniture, particularly furniture for sitting, such as chairs, loveseats, sofa, and sectionals, have heretofore been generally designed for either permanent use at a given location or for temporary use to be moved about easily. Such furniture for permanent use has generally been constructed with a rigid frame to which the upholstery is permanently attached so as to not generally be movable relative thereto (except, of course for removable cushions and the like). Such permanent type upholstered furniture is also generally heavy and bulky, being difficult to store and transport, generally requiring special facilities and handling by skilled movers or furniture handlers.

Portable furniture, on the other hand has been previously suggested, which may be easily stored and transported. Such furniture is generally designed to be as light in weight as practicle and to either fold or stack for storage. Upholstery is generally minimal on such furniture, being limited to a simple seat cushion, perhaps a small back cushion, and rarely, small arm cushioning. Overall upholstery, however, is rarely provided, or clearly denotes the folding or temporary nature of the furniture.

Chairs, and the like, have also been heretofore suggested wherein bands of cloth or the like have been combined with frameworks, either folding or rigid, to provide slings for supporting people more or less comfortably. In some instances such bands or slings also provide sume structural interaction with the frame members, as providing limits beyond which the frame members cannot extend. Hence, slings and frames have been combined into such furniture as director's chairs and butterfly chairs.

Further, slip covers have been heretofore suggested to be form fitted over chairs, settees, sofas, and the like. Generally to enable the color or pattern of the upholstery to be easily changed, or to provide protection for the permanent upholstery of the piece. Such slipcovers, however, seldom if ever have any active cooperation with the framework and therefore do not provide any structural part of the furniture. Furniture wherein a removable fabric covering and a frame structurally interact heretofore required complex fastening systems therebetween. Ease of portablility is therefore adversely effected, as are cost and weight of the assembly.

Rohrer U.S. Pat. No. 762,441 (June 14, 1904) relates to a folding go-cart (perambulator or stroller) having laterally collapsible side frame members joined by medially hinged and foldable seat and foot supporting members providing a rigid frame when unfolded. The seat back also comprises two foldable members hinged together in the middle.

Gutter U.S. Pat. No. 1,420,095 (June 20, 1922) relates to a laterally folding chair having back and seat members also centrally hinged and hinged to side frames. The side frames include tubular members and the hinging thereto of the back and seat members is by means of straps secured thereto and passing around the frame tubular members.

Green U.S. Pat. No. 1,736,473 relates to a collapsible bench having plural sections, each of which comprises a side frame and fabric seat and back members spanning therebetween. The intermediate side frames comprise common frames for the seat sections on each side thereof.

Masury U.S. Pat. No. 1,763,001 relates to seat upholstery especially for seats such as in passenger carrying vehicles and particularly to removable slip covers. Separate covers are provided for the seat cusion and the back, the back covers having snap fastener elements cooperating with mating elements on the seat backs.

Fisher U.S. Pat. No. 1,933,372 (Oct. 31, 1933) relates to slip coverings for arm chairs which are installed downwardly over the chair back and seats and which include arm cover portions. Zipper type fasteners are used to hold the slip cover in place.

Johnson U.S. Pat. No. 2,001,252 (May 14, 1935) relates to a foldable chair comprising a plurality of closely spaced parallel slats held in pockets in cooperating fabric sleeve members. Separate sets of slats are used for the seat and the back portions or sections, and the chair folds between the seat and back portions. No legs or arms are provided.

Liska U.S. Pat. No. 2,043,669 (June 9, 1936) relates to a prie dieu having padded knee rests and top plates hinged centrally from laterally foldable side frames. A centrally disposed supporting bracked depends from the central hinge area of the knee rests.

Cornish U.S. Pat. No. 2,632,654 (Mar. 24, 1953) relates to a folding perambulator having centrally hinged seat and foot rest portions hinged to a pair of laterally foldable side frames. A seat cushion is provided and the back is also cushioned.

Lee U.S. Pat. No. 2,847,058 (Aug. 12, 1958) is to a folding wheel chair having a centrally hinged seat hinged to a pair of side frames. A centrally hinged parallel linkage is beneath the seat sections and connected thereto by a vertical link bar.

Adler U.S. Pat. No. 2,934,134 (Apr. 26, 1960) relates to a folding seat having generally rigid seat and back frames hinged together at the seat-back juncture. Each of the seat and back frames are loosely filled by woven webbing strips.

Faulkner et al U.S. Pat. No. 3,104,913 (Sept. 24, 1963) relates to a knock-down sofa having separable frame forming members fastenable together and a slip cover therefore. Interchangeable slip covers may be provided and selectively fastened to the assembled frame. Various fastening means are used for assembling the slip covers with the frame.

Putnam U.S. Pat. No. 3,490,810 (Jan. 20, 1970) relates to a chair having a generally rigid frame onto which an upholstered or cushioned cover may be vertically lowered. The cushioned cover is invertable so as to be reversible on the frame while the cushioned sections remain joined together.

Kelley U.S. Pat. No. 3,589,770 (June 29, 1971) relates to furnature, such as couches and the like having changeable slip covers, with the couch itself being upholstered only in plain undecorative durable ticking, burlap, canvas or the like, but including all of the padding and the like. The changeable slip cover, therefore, is decorative only, serving no structural or cushioning function.

Macheu U.S. Pat. No. 3,838,883 (Oct. 1, 1974) relates to a folding chair frame of rod elements for a cover-seat only vaguely described therein but referred to as being of the "butterfly" design. The cover-seat is apparently for forming a body support sling only, and does not appear to structurally cooperate with the chair frame, there being provided a separate lugged clip to act as a stop and limit the degree to which the frame may be opened.

Miller U.S. Pat. No. 4,089,497 (May 16, 1978) does not relate to chair or seating type furniture at all. Rather it relates to bed frame rails and, more particularly, to padded caps to be fitted onto bed rails. It does, however, disclose such caps comprising padding and covering layers overlaying a resiliently compressible member of generally inverted U-shaped configuration.

Schoblom U.S. Pat. No. 4,092,049 relates to a knock-down chari construction of the armless type having a pair of molded side frame members detachably connected by a plurality of parallel tube members extending detachably therebetween together with a fabric cover stretched over the frame and tied thereto beneath the frame. The seat and back portions are, in effect, slung between the upright side frame members, are not padded in the manner of conventional upholstered furniture and the overall design is limited substantially to the design shown in the patent drawings; little freedom of design is offerred with only a straight line or parallelipiped being permissible between the side frame uprights. Hence, the design freedoms and appearance of conventional upholstered furniture can not be achieved.

Accordingly, the prior art chairs and other seating units such as are heretofore known have not been able to provide portable furniture that is light weight, easy to transport, store, set up and take down, while yet permitting of the appearance and comfort of conventional upholstered furniture.

OBJECTS OF THE INVENTION

Bearing in mind the foregoing, it is a primary object of the present invention to provide portable furniture that is light in weight, easy to transport, store, set up and take down, and which is yet permitting of the appearance and comfort of of conventional upholstered furniture.

It is another primary object of the present invention, in addition to the foregoing object, to provide such furniture which is durable and sturdy in use while yet inexpensive to manufacture and distribute.

It is still another primary object of the present invention, in addition to the foregoing objects, to provide such furniture presenting great freedom of style and design appearance.

It is yet another primary object of the present invention, in addition to each of the foregoing objects, to provide such furniture which may be easily adapted for indoor and/or outdoor use, and which may be weather resistant if desired.

It is yet still another primary object of the present invention, in addition to each of the foregoing objects, to provide such furniture wherein the padded portions may be easily removed, for separate storage, and the like, when desired.

Yet another primary object of the present invention, in addition to each of the foregoing objects, is to provide such furniture having fabric portions which may be easily changed and/or interchanged as may be desired.

Yet still another primary object of the present invention, in addition to each of the foregoing objects, is to provide such furniture opholstered fully, as with a skirt portion extending to the floor, or open, with open legs showing beneath the upholstered portion.

Yet another and still further primary object of the present invention, in addition to each of the foregoing objects, is the provision of such furniture expecially adapted for the provision of seating type furniture, such as chairs, setees, loveseats, sofas, couches, and sectional furniture of diverse period styles and appearance.

The present invention resides in the combination, construction, arrangement and disposition of the various component parts and elements incorporated in new and improved portable upholstered furniture and in methods of assembling and disassembling, as well as unfolding and folding, portable upholstered furniture in accordance with the principles of this invention. The present invention will be better understood and objects and important features other than those specifically enumerated herein will become apparent when consideration is given to the following details and description which, when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein and such other embodiments or modifications are intended to be reserved, especially as they fall within the scope and spirit of the subjoined claims.

BRIEF SUMMARY OF THE INVENTION

In accordance with the present invention, portable upholstered furniture is defined by a laterally folding frame having a pair of laterally collapsible side arm frames and a pair of medially foldable parallelogram cross assemblies extending therebetween defining, in their unfolded configurations a horizontally extending seating support surface above and an auxilliary surface below; at least one generally transversly flexible band of fabric or the like encircling the side arm frames; and a cushioned bonnet like upper assembly settable downwardly onto the frame and band, cushioning the seating support surface and the arm portions of the side arm frames, and at least partially overlapping the encircling band. Preferably, the encircling band is provided with a plurality of vertically extending strut members engaging at least the peripheral portion of the seating support surface at least partially peipherally thereof to enable the encircling band to follow the contour there, whether flat or curved, and in back, to extend both upwardly and downwardly past the seating support surface to define thereat a smooth, continuous, or sculptured back panel covering both the chair back and seat base. Yet further, the vertical struts may be provided with support blocks for supporting the seating support surface in its unfolded position, as well as the auxiliary surface for added rigidity if desired. The encircling band may be permanently attached to the side arm frames or removably affixed thereto, if desired, for easy interchange. The encircling band may extend all the way to the floor for a full skirted appearance or the lower portion of the side arm frames may remain exposed as open leg portions. While in one embodiment or modification the side arm frames include upwardly extending arm portions, it is within the pervue of the present invention not only to provide furniture with both or all of the side arm frames including side arm portions, but also to provide furniture with only one arm and one side armless, the armless side having the side arm frame thereat truncated substantially at or adjacent the seat level with the arm defining portion thereof being eliminated, as for a sectional, or modular end or corner unit. Further, within the purvue of the present invention both arms can be eliminated and both side arm frames truncated substantially at or adjacent the seat level with the arm portion thereof being eliminated, as for an armless chair or sectional or modular unit. Yet further, more than two side arm frames may be used, as for multiple seating units, and any desired number thereof may be armless or with arm portions. Accordingly, throughout the following specification and the subjoined claims it shall be understood that the term side arm frame refers to the frame capable of including an arm portion whether or not it does so include an arm portion and whether or not it is truncated so as to be armless with the arm portion that could be included therewith has been eliminated.

BRIEF DESCRIPTION OF THE DRAWING

Although the specification concludes with claims particularly pointing out and distinctly claiming the subject matter which is regarded as forming the present invention, it is believed that the invention will be better understood and objects and important features other than those specifically enumerated herein will become apparent from the hereinafter set forth detailed description of the invention taken in conjunction with the annexed drawing, in which:

FIG. 8 is a perspective illustration of the upper bonnet-like cushioned portion of the chair of the preceding figures showing how the upper bonnet like portion may be readily removed and separately folded for transportation and storage;

FIG. 9 is a perspective illustration of another chair embodiment incorporating the principles of the portable upholstered furniture of the present invention;

FIG. 10 is an enlarged partial cross-section illustration taken along line 10—10 of FIG. 9.

Figure 1:
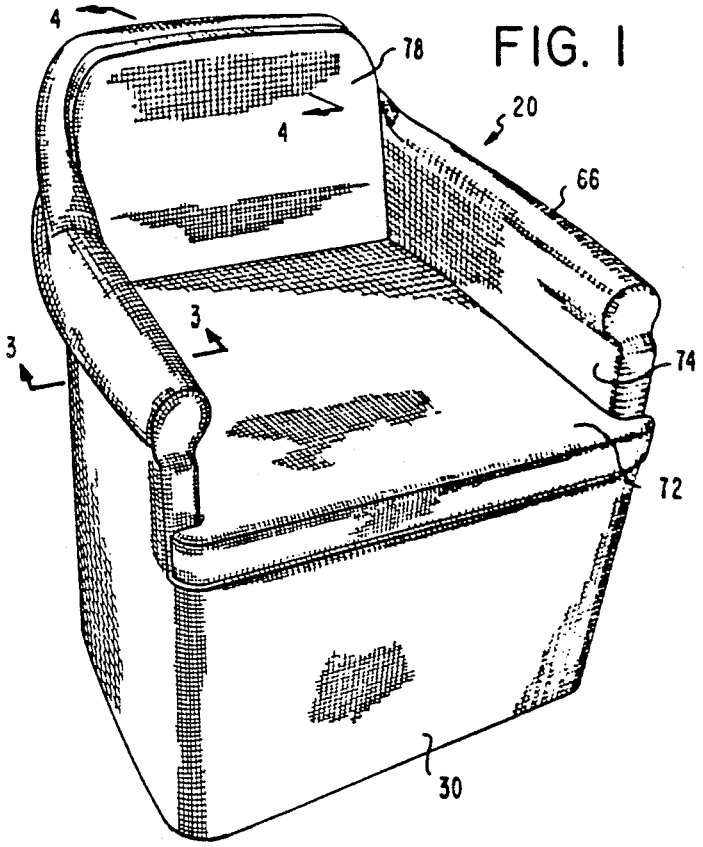
FIG. 1 is a perspective illustration of a chair incorporating the features of the portable upholstered furniture of the present invention.
Figure 3:
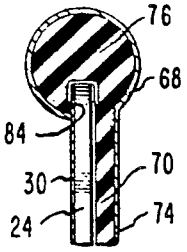
FIG. 3 is an enlarged cross-sectional partial view taken along line 3—3 of FIG. 1.

With reference now to the drawing, and particularly to FIGS. 1–7 thereof there is shown and illustrated an article of portable upholstered furniture constructed in accordance with my invention as specifically embodied in a portable upholstered chair designated generally by the reference character 20. While the chair 20 is illustrated as the type of chair that may be called a barrel chair, with the frame and legs being fully covered with the upholstery extending completely to the floor so as to cover the legs or leg substitute structure to be described in more detail hereinafter, it is to be expressly understood that it is the intent to cover within the ambit of my invention chairs of other styles, including, by way of example and not by way of limitation chairs having various and diverse types of open framework, such as chairs with extended and exposed legs, open arms, flat or curved panels, and the like.

Figure 2:
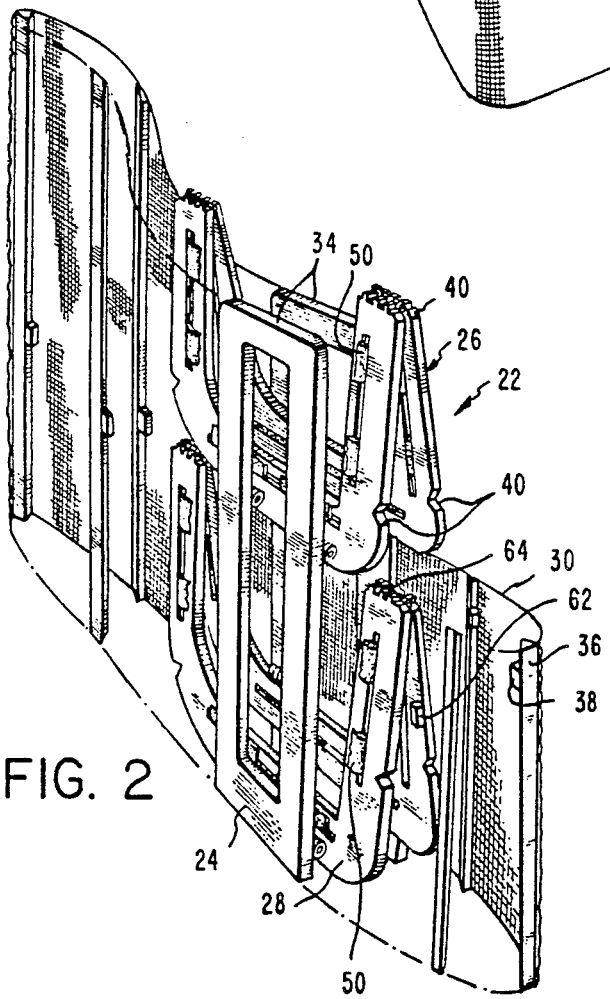
FIG. 2 is a perspective illustration of the chair of FIG. 1 with the upper or bonnet like cushioned portion removed therefrom and the lower frame portion thereof laterally collapsed for transportation or storage.
Figure 4:
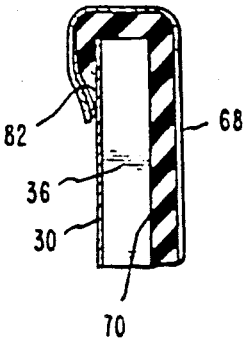
FIG. 4 is an enlarged cross-sectional partial view taken along line 4—4 of FIG. 1.
Figure 5:
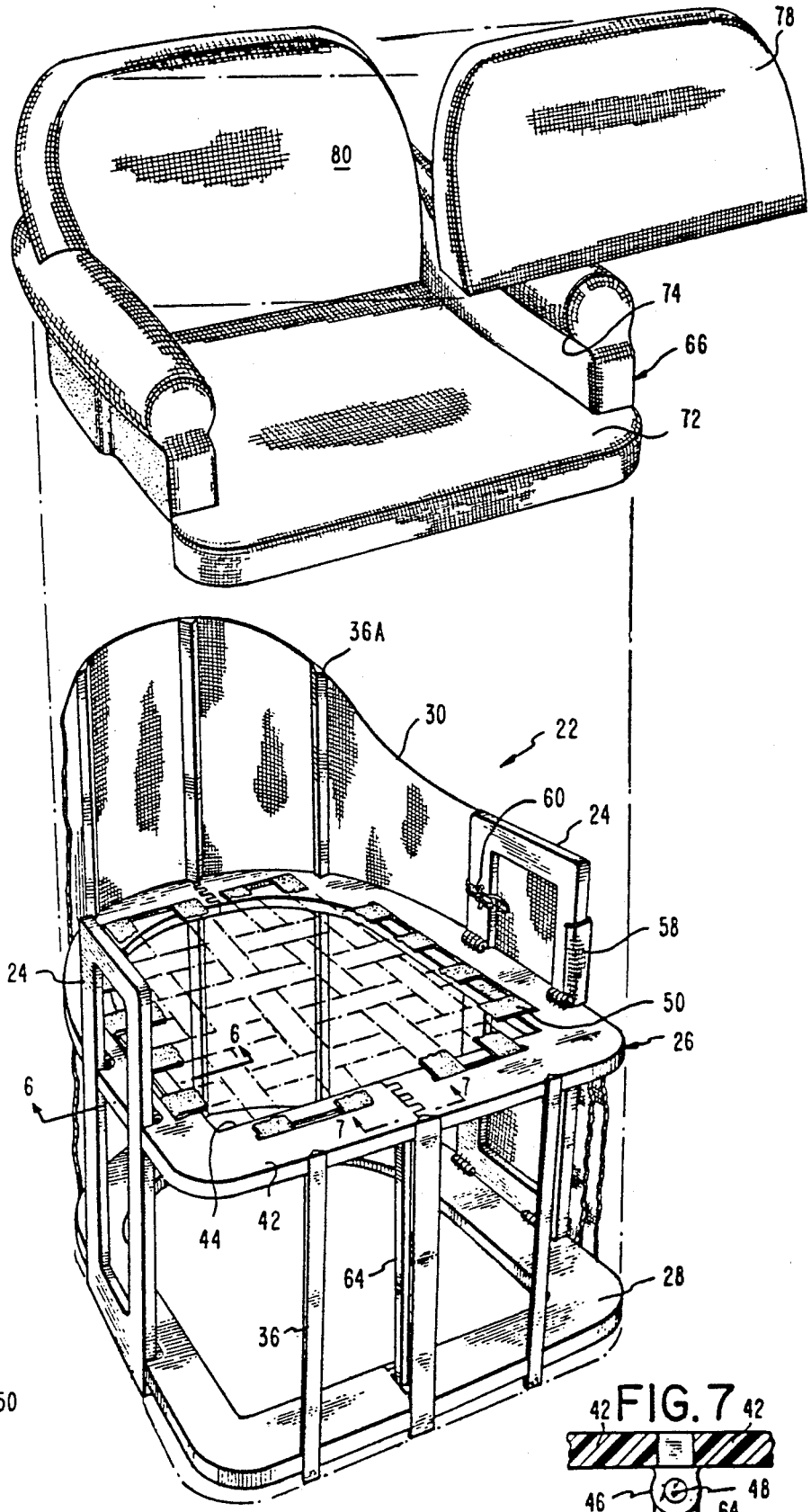
FIG. 5 is an exploded partially broken away perspective illustration of the chair of FIG. 1 showing how it may be easily assembled and disassembled.
Figure 6:
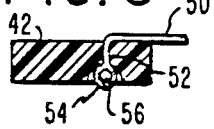
FIG. 6 is an enlarged cross-sectional partial view taken along line 6—6 of FIG. 5.
Figure 7:
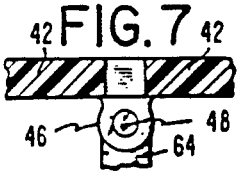
FIG. 7 is an enlarged cross-sectional partial view taken along line 7—7 of FIG. 5.

The exemplary chair 20, as best seen in FIGS. 2 and 5 comprises a laterally folding frame 22 having a pair of laterally collapsible side arm frames 24 and a pair of medially foldable parallelogram cross assemblies 26 and 28 extending therebetween defining in their unfolded configurations a horizontally extending seating support surface above and an auxiliary surface below. The chair further comprises at least one generally transversely flexible band of fabric or the like 30 encircling the side arm frames 24 and support surfaces 26 and 28 therebetween. Finally, the chair 20 includes a cushioned bonnet-like upper assembly 66 settable downwardly onto the frame 22 and band 30, cushioning the seating support surface 22 and the arm portions 34 of the side arm frames 24. The encircling band 30 is provided with a plurality of vertically extending strut members 36 which may, for example, be adhesively adhered thereto and which, in the set up or unfolded orientation engage at least the peripheral portion of the seating support surface 26. In such engagement, the vertical strut members 36 may, for example, be provided with support block portions or members 38 upon which the seating support surface 26 rests and is supported when the chair or other article of furniture is in its orientation for seating use. In this manner, cross braces or latching mechanisms for the seating support surface 26 are not required and the support block members or portions 38 function as positive stops against excessive downward movement of the seating support surface and providing the feel of rigidity associated with permanent upholstered furniture and oftentimes missing in conventional folding furniture.

The at least partial peripheral engagement of the encircling band 30 with the seating support surface 26 also contributes both structurally and aesthetically to the utility of my furniture of the present invention. The band 30 adds to and actually forms an integral assembly with the laterally foldable or collapsable frame 22 and together therewith provide the rigidity and solidarity usually only associated with permanent upholstered furniture. In addition, although the band 30 is generally flexible, in the set up configuration it is fully supported and therefore allows for a diverse range of design or appearance options to be fully implemented, especially if the curved surfaces are restricted to convex curves. Limited concave surfaces may, however, also be implemented, although additional or suplementary stiffening thereof may be desirable.

The vertical support struts 36 also provide an important structural and aesthetic versatility to my invention in enabling the fabric or other flexible material encircling band 30 to extend above the seating surface 26, especially in the back portion of the chair 20 or other article of furniture in accordance with the present invention. Hence, struts 36A may be provided in the back region of the chair 20 which extend upwardly past the seating support surface 26. As shown, the struts 36 and 36A may closely fit with the seating support surface 26, secured thereagainst to preclude rocking movement as by being congruent with notches 40 provided therein for lateral stability. However, I have found that, in general such close fitting of the struts 36 and 36A and notches 40 is not essential, at least when the chair 20 is new, although a close fit therebetween may aid in maintaining rigidity and stability over time. As shown, the struts 36A in the back region extend both upwardly and downwardly of the seat support surface 26 to define thereat a continuous seat base and back to the chair 20, either flat or curved. Also, it is within the ambit of the present invention to have the encircling band 30 either pemanently attached to the side arm frames and/or the struts 36 and/or 36A or removably attached thereto, if desired, for easy interchange to enable the color or style of the furniture to be easily changed.

The encircling band 30, although basically flexible, is as heretofore pointed out a basic structural part of my furniture and provides rigidity and solidarity thereto. While the encircling band is preferably comprised of a decorative and durable fabric, other materials may be used, ranging, for example from metal sheet or foil to paper and other disposable materials. Corrugated cardboard, especially with the corrugations running vertically may be used. Of course, use of cardboard would not readily permit of permanent use, nor use for extended periods outdoors, but proper material selection would permit easily of all-weather or outdoor furniture. As used herein, however, the term fabric is intended to cover use of all such materials. Preferably, however, I have found that a fabric having limited stretch is preferable, and laminated structures, such as relatively thin fabric laminated to buckram has been found successful.

The seating support surface 26 may be formed in a number of differing manners. For example, the seating support surface 26 may comprise two simple planar members of wood or the like, or may be molded, for example of plastic material so as to provide some resiliency in the central portion thereof for user comfort. Preferably, however, and as shown, the seating support surface 26 comprises a pair of generally U-shaped or bow shaped frame pieces 42 defining the periphery of the seating support surface 26 and providing fenestration 44 in the central portion thereof when the chair 20 is in the set up configuration as shown, for example in FIG. 6. The two pieces 42 may be hinged together at their ends, as by integrally formed hinge parts 46, hingedly interconnected as by a hinge pin 48 as shown in more detail in FIG. 7. The center portions of the members 42 may be similarly hinged to the arm frames 24. In each instance, the the hinge pins are preferably offset sufficient to enable the various panels to fold completely, that is, flat one against the other. Across the central fenestration 44, a resilient support surface may be strung defined, for example, by spring material such as zig-zag spring wire or, as shown, interlaced or interwoven webbing strips 50 which may be secured to the frame pieces 42 in any convenient manner. For example, as shown in the detail, FIG. 6, the ends of the webbing strips 50 may pass through slots 52 and be provided with end loops 54 held in position by means such as pins or rods 56 extending therethrough. In this manner a very comfortable and durable seating surface can be formed which is yet easily folded, light inweight, and, if the strips 50 are of plastic or the like may be weather resistant.

The fabric band 30 is generally movable relative the frame allowing the chair to be easily folded to a flattened configuration as shown in FIG. 2 for transportation and storage. Yet, when the chair is unfolded the band 30 forms a tight band therearound as shown in FIG. 5. The chair can be easily collapsed or folded by a slight upward pull to the seating support surface 26, or the webbing 50 easily followed by inward movement of the side arm frames 24. Just as easily, an outward pull on the side arm frames 34, followed by a downward push against the seating support surface against the support blocks or stops 38 sets up the frame. No other locks, only the friction and orientation of the seat support surface against the band 30 and vertical struts 36 and 36A. Although generally movable relative the frame, the band 30 is preferably attached to the side arm frames 24, in at least limited locations so that the band 30 and the frame portions 24, 26, and 28 may be conveniently handled as an integral unit. In addition, portions of the frame not to be exposed but not on the peripheral surface of the chair 20, such as the outside corners of the side arms above the cushion level may be thereby covered to complete the upholstered character of the chair. Hence, the outside upper corners of the side arm frames are covered by extensions of the band 30 designated by the reference character 58, see particularly FIG. 5. This attachment may be permanent, as by glue, adhesive, nails, decorative or plain tacks, and the like or may be more easily removable as for cleaning or changing of the cover, as by snap fasteners, interlocking loop and pile fabrics such as sold under the trade mark Velcro, and the like. Additional fastening may be provided, such as ties 60.

As heretofore pointed out a lower folding surface 28 is preferably for additional strength and rigity, and to increase the stability both of the structural support members and of the fabric band 30, adding to the sturdy, upholstered character of appearance of the chair 20 This lower frame or surface 26 may be identical or generally similar to the seating support surface 28, except that the seat webbing 50 is not needed. Further, the surface or frame 28 need only be parallel to the seating support surface 26. The lower surface 28 may be at the floor line, although is preferably spaced slightly above the floor line so as to avoid floating thereof if the chair 20 is used, for example on grass or high pile carpeting. Support blocks (not shown) may be provided on the vertical struts or (as shown in FIG. 2) support blocks 62 may be provided on the surface 28 itself. However, such support blocks are not generally needed—the lower surface 28 is not generally intended to carry the user's weight. Rather, as pointed out above it fills out the chair contours and provides rigidity to the overall structure. The lower surface 28 is connected for movement, folding and unfolding with the upper or seating surface 26. Means, such as a tie-bar 64 hinged at top and bottom to the upper surface 26 and the lower surface 28 provide the desired connection. Additional tie-bars can be provided but generally are not needed. Again, it is not intended that the tie-bar or tie-bars carry the user's weight. Rather, the tie-bar 64 is an aid in collapsing or folding the chair and in un-folding or setting it up by keeping the frames 26 and 28 parallel. Hence, in setting up the chair, a slight downward push on the upper seating surface or the frame thereof, will be transmitted by the tie-bar to the lower surface or frame 28 and will therefore position it properly and maintain it in that position. This is one of the reasons that the blocks 62 are not generally necessary. On the other hand, rigid tie bars and blocks such as those at 62 can provide a secondary path for the weight of the user, if desired but, in general, only add to the cost, complexity, weight, and compactness of the folded chair. As detailed in FIG. 7, the tie-bar 64 may have its ends journaled on the same pins 48 as are used to hinge the frames 26 and 28 together. If desired, the lower frame 28 may be substantially narrower and lighter that the seating support surface, or for convenience of manufacture and parts inventory may be identical thereto. The tie-bar 64, of course, also aids in collapsing the chair, a simple upward pull to the upper or seating support surface is also transmitted therethrough to the lower surface 28.

As will now be apparent, the band 30 provides an upholstered look to all of the exposed surfaces of the chair 20 which in ordinary usage are only visually perceived and not tactilly perceived. That is, the band 30 covers the lower and rearward surfaces against which the user's body does not bear or rest in normal use. Hence, the physical needs for cushioning are not present and cushioning thereof may generally be dispensed with, although cusioned fabrics may, of course, be used, as may generally any type of treatment which might enhance the visual appearance or impact. Differences, however arise in those areas or regions in which tactile impression is significant. These areas generally are the upper and forward directed surfaces of a chair. In accordance with the present invention, these regions are covered and upholstered in their entirety by a bonnet like cushioned and upholstered unit or assembly 66 which generally although not necessarily is entirely constructed of flexible materials and does not generally contain any rigid elements, except as will be pointed out hereinafter, so that it also may be easily collapsed although by a different mechanism than the lower unit.

The bonnet like upper unit 66 is, therefore, primarily constructed of fabric and cusioning material, such as plastic or rubber foam. The fabric cover material 68 may completely encase the cushioning 70, as by being sewn therearound as in conventional pillow or cushion construction. Alternatively, those portions not usually seen in use may be covered with a simple inexpensive fabric and, again, conventional sewing techniques may be used. On the other hand, techniques not usually associated with conventional upholstered furniture may also be used, such as laminating and bonding techniques, either laminating covering fabric 68 to pre-cut or formed cushions 70 by adhesive processes or the cushioning 70 may even formed against and thereby bonded to the covering fabric 68 in molds or the like as has become common in special purpose manufacture such as automobile and other vehicular seats.

Regardless of how formed, however, the bonnet like upper assembly or portion 66 is intended to be assembled with the lower set up assembly by the simple expedient of lowering it into position, with such minimal hand position of specific fabric edges and the like, and smoothing as may be necessary. The bonnet like upper assembly or unit 66 provides upholstery and cushioning of the seat 72, inner arms 74 above the cusioning of the seat 72, and upper arm edges or rolls 76. In the inner or forward back region, I have found it expedient to provide all or the main cushioning by a separate pillow type cusion 78 of boxed construction. This provides for easier collapse or folding of the upper bonnet-like assembly or unit, as will be seen hereinafter, by reducing the amount of the cushioning 70 that need so be folded or compressed. Preferably, similar rolling of cushion material 70 extends in the unit 66 from the arm rolls 76 across the top of the chair back 80 to provide both stiffening to the upper assembly or unit 66 and padding of the chair back edge should someone rest an arm or hand on it. The seat cushioning should be thick, the inner arm cushioning thinner and the arm and back rolls, heavier and somewhat lighter, respectively. The inner back area may be totally uncushioned, except for the separate back cushion 78, or may be very lightly cushioned for additional body to the unit 66.

Generally, as described, the unit 66 comprises only fabric and cushioning, and simply drops into position on the lower unit 22. However, the lower margin of the back edge roll may be provided with a thin elastic band 82 for a snugger fit. Also, the arm rolls 76 may be provided with stiffening to aid in holding them in position and neat, such as a relilient channel member 84 of inverted generally U-shaped configuration, which may tightly engage the upper edge of the arm frame 24. The bonnet like upper unit or assembly 66, as heretofore pointed out, also folds generally flat, which then, with the back cushion 78 and the frame 22 also folded or collapsed forms a very flat and compact package. With reference now to FIG. 8, the side arm cover portions 74 may be folded towards the center of the cusion portion 72, and then the back portion 78 folded on top thereof.

A tight fit of the fabric band 30 peripherally around the surfaces 26 and 28 is important for both rigidity and appearance. In order to enable manufacturing tolerances and the like to be accommodated, it is desirable that at least one of the band 30 and the frame 22 be adjustable during assembly. With reference now to FIG. 9, there is shown and illustrated another embodiment of collapsible frame designated by the reference character 22' which may, in essential detail be substituted for the frame 22 of the preceding figures but which allows for easy adjustment during assembly.

In describing the assembly 24', like reference characters are used for the several parts as in the previous figures, and where the several parts are similar but with modification, the reference characters are primed. Similar convention is used in FIG. 10 which is an enlarged detail of FIG. 9 and in FIG. 11 which shows another embodiment, wherein modified parts bear like reference characters, but double primed. The upper or seating support surface 26' and the lower surface 28' of the assembly 24' comprise forward and rearward portions 84 and 86 joined by hinges 46'. The portions 84 and 86 also are joined front to back by pivot bar assemblies designated generally by the reference character 88 telescopingly comprising inner and outer tubular members 90 and 92 respectively fixed, for example, to the front and rear portions 85 and 86, although front to inner or rear to inner is of no import. The important aspect is that they form pivots for the seating surface 26' and the lower surface 28' relative the arm frames 34' and, also, that they are capable of telescopic movement for length adjustment, i.e., depth of seat. For example, and with particular reference to FIG. 10, during manufacture an appropriate fabric band may be installed, and then the tubes 90 and 92 telescoped outwardly or extended against the resistance of the fabric band so as to be tight, and then locked in position, as by being deformed by dimpling 94.

The tubes 90 and 92 also provide for the hinging action relative the side arm frames 34' which may be provided, for example by curved straps 96 and nylon or other plastic bushing members between the straps 96 and the tubes 90 and 92. The straps 96 may be attached to the side arm frames 34 in any convenient manner, as by screw, rivets, or the like, or may comprise apertured bosses, or the like, integrally formed with the side arm frames 34.

Figure 11:
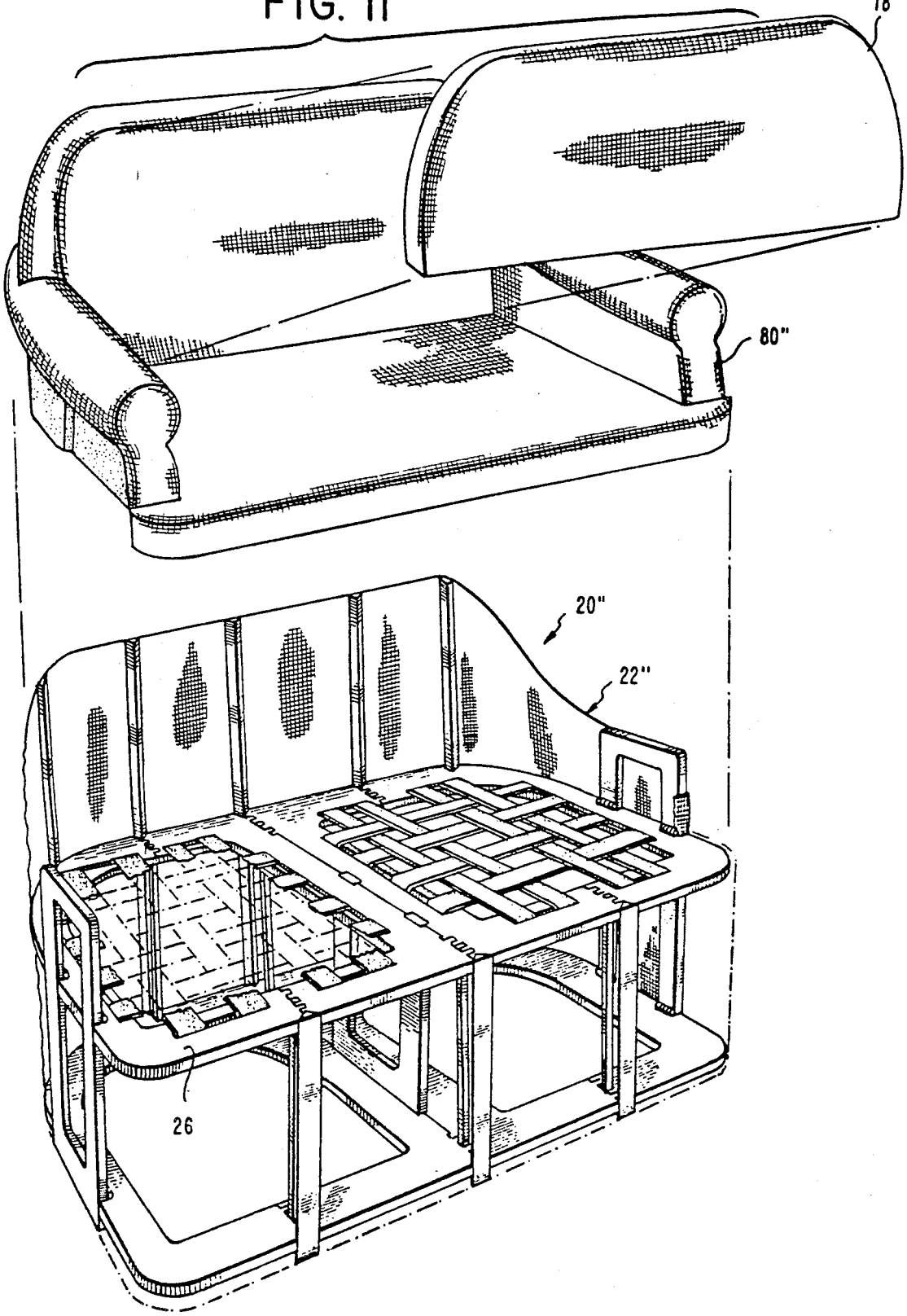
FIG. 11 is an exploded perspective illustration similar to FIG. 5 of another embodiment of portable upholstered furniture in accordance with the present invention as embodied in a two-seater sofa or loveseat.

As heretofore pointed out, it is an aspect of the present invention that it is applicable to diverse types and styles of furniture, and with reference now to FIG. 11 there is shown and illustrated a two seater setee or loveseat constructed in accordance with the present invention. Of course, a two seat setee or loveseat could be constructed utilising only the strucural embodiment of FIGS. 1–7 merely by making the seat sufficiently wide relative the seat depth. However, preferably the principles of the present invention are applied with more imagination to maintain the ease of handling of the present invention while retaining the seating or support qualities of separately springing or supporting each user. Accordingly, a setee or loveseat designated 20" is shown and illustrated having two seating support surfaces 26 arranged side by side, on either side of a truncated side support 34" which does not extend above the seating support surfaces 26. Except for the wider width and the need to fold each side separately, the structural details are similar to that of the previous embodiments.

While the invention has been described, disclosed, illustrated and shown in terms of certain embodiments or modifications which it has assumed in practice, the scope of the invention should not be deemed to be limited by the precise embodiments or modifications herein described, disclosed, illustrated or shown, such other embodiments or modifications as may be suggested to those having the benefit of the teachings herein being intended to be reserved, especially as they fall within the scope and spirit of the claims hereto appended.

I claim:

1. Portable upholstered furniture defined by a laterally foldable frame having a pair of laterally collapsible side frames and a pair of medially foldable cross assemblies of a generally parallelogram form in their generally vertical cross-sectional projections extending therebetween, at least one generally transversely flexible band of fabric or the like encircling the side frames and the cross assemblies, and a cushioned bonnet like upper assembly settable downwardly onto said frame, at least one of the encircling band and the frame being provided with at least one vertically extending strut member supporting a portion of the cushion assembly, and at least one of the band and the frame carrying support means for supporting at least one of said cross assemblies.

2. Furniture defined in claim 1 further including a generally vertical tie bar means extending between said cross assemblies.

3. Furniture defined in claim 2 wherein said tie bar means is generally rigid and hingedly connected with both said cross assemblies.

4. Furniture defined in claim 1 wherein said cross assemblies are hingedly connected with said side frames.

5. Furniture defined in claim 1 wherein the upper one of said cross assemblies defines a seating surface and said seating surface comprises a resilient portion.

6. Furniture defined in claim 5 wherein said resilient portion comprises webbing or strip material stretched across a fenestration in said seating surface.

7. Furniture defined in claim 1 wherein the upper one of said cross assemblies defines a seating surface and at least one vertical strut extends upwardly therepast supporting a back portion of said bonnet like upper assembly.

8. Furniture defined in claim 7 wherein said side frames extend upwardly past said seating portion and define side arms.

9. Furniture defined in claim 7 where less than all of said side frames extend upwardly past said seating surface to define side arms, at least one of said side frames terminating at or below said seating surface and enabling said seating surface to extend therepast.

10. Furniture defined in claim 9 wherein there are at least three said side frames and two pairs of side by side cross assemblies hingedly mounted to opposite sides of an intermediate one of said side frames.

11. Furniture defined in 9 wherein said upper assembly provides cushioning for said side arms.

12. Furniture defined in claim 11 wherein said upper assembly includes channel members for engaging said side arms.

13. Furniture defined in claim 1 wherein said cross assemblies are adjustable at least at the time of assembly to enable for adjustment to differing size encircling band.

14. Furniture defined in claim 1 wherein said encircling band substantially covers the furniture surfaces viewable to a user while said upper portion covers substantially all of the furniture normally exposed tactily.

15. Furniture defined in claim 1 wherein said band is permanently affixed to said frame.

16. Furniture defined in claim 1 wherein said band is removably attached to said frame.

17. Furniture defined in claim 1 wherein said band is fabricated of weather resistant material.

18. Furniture defined in claim 1 wherein the upper one of said cross assemblies defines a seating surface and at least one of said side frames extends upwardly therepast supporting a back portion of said bonnet like upper assembly.

* * * * *